US009347738B1

(12) United States Patent
Schumacher

(10) Patent No.: US 9,347,738 B1
(45) Date of Patent: May 24, 2016

(54) FOLDING STOCK ATTACHMENT WITH MODIFIED BOLT CARRIER FOR AUTOMATIC RECOIL RIFLES AND PISTOLS

(71) Applicant: Theodore R. Schumacher, Pewaukee, WI (US)

(72) Inventor: Theodore R. Schumacher, Pewaukee, WI (US)

( * ) Notice: Subject to any disclaimer, the term of this patent is extended or adjusted under 35 U.S.C. 154(b) by 0 days.

(21) Appl. No.: 14/928,208

(22) Filed: Oct. 30, 2015

Related U.S. Application Data

(60) Provisional application No. 62/073,223, filed on Oct. 31, 2014.

(51) Int. Cl.

| | |
|---|---|
| ***F41C 7/00*** | (2006.01) |
| ***F41C 23/04*** | (2006.01) |
| ***F41C 23/10*** | (2006.01) |
| ***F41A 3/12*** | (2006.01) |

(52) U.S. Cl.
CPC . *F41C 23/04* (2013.01); *F41A 3/12* (2013.01); *F41C 23/10* (2013.01)

(58) Field of Classification Search
CPC ..... F41C 23/04; F41C 23/10; F41C 23/14
See application file for complete search history.

(56) References Cited

U.S. PATENT DOCUMENTS

| | | | | |
|---|---|---|---|---|
| 8,631,601 | B2 | 1/2014 | Langevin et al. | |
| 8,769,855 | B2 | 7/2014 | Law | |
| 8,955,422 | B1 * | 2/2015 | Schumacher | F41A 3/12 42/72 |
| 8,991,088 | B1 * | 3/2015 | Young | F41A 25/00 42/75.03 |
| 2011/0131857 | A1 * | 6/2011 | Kuczynko | F41A 3/84 42/73 |
| 2012/0137562 | A1 * | 6/2012 | Langevin | F41C 23/04 42/75.03 |
| 2013/0212920 | A1 * | 8/2013 | Law | F41C 23/14 42/75.03 |
| 2015/0345895 | A1 * | 12/2015 | Young | F41A 11/04 42/71.01 |

* cited by examiner

*Primary Examiner* — Gabriel Klein
(74) *Attorney, Agent, or Firm* — Donald J. Ersler

(57) ABSTRACT

A modified bolt carrier for automatic recoil rifles and pistols preferably includes a modified bolt carrier, a folding stock member, a shortened buffer tube, an end cap, a butt stock threaded tube and a bolt carrier sleeve. A sleeve bore is formed in the modified carrier bolt to receive the bolt carrier sleeve. The folding stock member includes a swing base and a swing arm. A tube bore is formed through the swing base to receive the shortened buffer tube. Upper and lower flanges extend from the swing base to retain a pivot pin. The swing arm includes a butt pivot arm, which extends from the stock ring. The pivot arm is pivotally retained on the swing base with the pivot pin. The butt stock threaded tube is threaded into the stock ring. The end cap includes an end cap portion and a guide rod.

9 Claims, 7 Drawing Sheets

FOLDING STOCK ATTACHMENT WITH MODIFIED BOLT CARRIER FOR AUTOMATIC RECOIL RIFLES AND PISTOLS

CROSS-REFERENCES TO RELATED APPLICATIONS

This is a non-provisional patent application, which claims the benefit of provisional application No. 62/073,223 filed on Oct. 31, 2014.

BACKGROUND OF THE INVENTION

1. Field of the Invention

The present invention relates generally to firearms and more specifically to a folding stock attachment with modified bolt carrier for automatic recoil rifles and pistols, which allows a stock to be folded to a right side of the firearm.

2. Discussion of the Prior Art

U.S. Pat. No. 8,631,601 to Langevin et al. discloses an automatic or semiautomatic rifle with folding clamshell buttstock. U.S. Pat. No. 8,769,855 to Law discloses a folding stock adaptor for military-style assault rifles and a method for its use.

Accordingly, there is a clearly felt need in the art for a folding stock attachment with a modified bolt carrier for automatic recoil rifles and pistols, which allows a stock to be folded to a right side of the firearm and which has a shorter length than that of the prior art.

SUMMARY OF THE INVENTION

The present invention provides a folding stock attachment with a modified bolt carrier for automatic recoil rifles and pistols, which has a shorter length than that of the prior art. The folding stock attachment with a modified bolt carrier for automatic recoil rifles and pistols (folding stock attachment) preferably includes a modified bolt carrier, a folding stock member, a shortened buffer tube, an end cap, a butt stock threaded tube and a bolt carrier sleeve. The modified bolt carrier includes a bolt end and a buffer end. A sleeve bore is formed in the buffer end of the modified carrier bolt to receive the bolt carrier sleeve. It is preferable to shorten the buffer end by 5-1 inch, before forming the sleeve bore. A sleeve spring is placed on the bolt carrier sleeve. A sleeve flange is formed on an end of the bolt carrier sleeve to retain the sleeve spring. The folding stock member includes a swing base, a swing arm, a pivot pin and an arm spring. A tube bore is formed through the swing base to receive the shortened buffer tube. A lower base flange extends outward from a bottom of the swing base and an upper base flange extends outward from a top of the swing base. Opposing ends of the pivot pin are retained in the upper and lower base flange. The arm spring is retained on the pivot pin.

The swing arm includes a butt stock ring and a pivot arm. The pivot arm extends from the stock ring. A pivot hole is formed through a distal end of the pivot arm. The pivot hole is sized to receive the pivot pin. A threaded bore is formed in the stock ring to threadably receive the butt stock threaded tube. The shortened buffer tube includes a first externally threaded end and a second externally threaded end. A tube flange is formed at an end of the first threaded end. A sleeve flange bore is formed in through the shortened buffer tube. The sleeve flange bore is sized to provide clearance for the tube flange.

The end cap includes an end cap portion and a guide rod. A threaded counterbore is formed in one end of the end cap portion. The threaded counterbore is sized to threadably receive the first externally threaded end of the shortened buffer tube. The guide rod is pressed into the end cap portion. A guide spring is placed on the guide rod. An inner perimeter of the bolt carrier sleeve is sized to receive the guide rod.

The folding stock attachment is preferably assembled in the following manner. The shortened buffer tube is inserted into the tube bore in the swing base. The second external threaded end is threaded into a lower receiver of a firearm. The bolt carrier sleeve is inserted into the shortened buffer tube and finally into the modified bolt carrier with the guide spring placed over the bolt carrier sleeve. The end cap is threaded on to the first external thread of the shortened buffer tube. One end of the butt stock threaded tube is threaded into the swing arm. The other end of the butt stock threaded tube is then threaded into a butt stock of a firearm. The swing arm is inserted into the swing base and the pivot pin inserted through the top and bottom flanges with a spring disposed below the pivot arm.

Accordingly, it is an object of the present invention to provide a folding stock attachment, which allows a stock to be folded to a right side of the firearm.

Finally, it is another object of the present invention to provide a folding stock attachment, which has a shorter length than that of the prior art.

These and additional objects, advantages, features and benefits of the present invention will become apparent from the following specification.

DETAILED DESCRIPTION OF THE PREFERRED EMBODIMENTS

Figure 1:
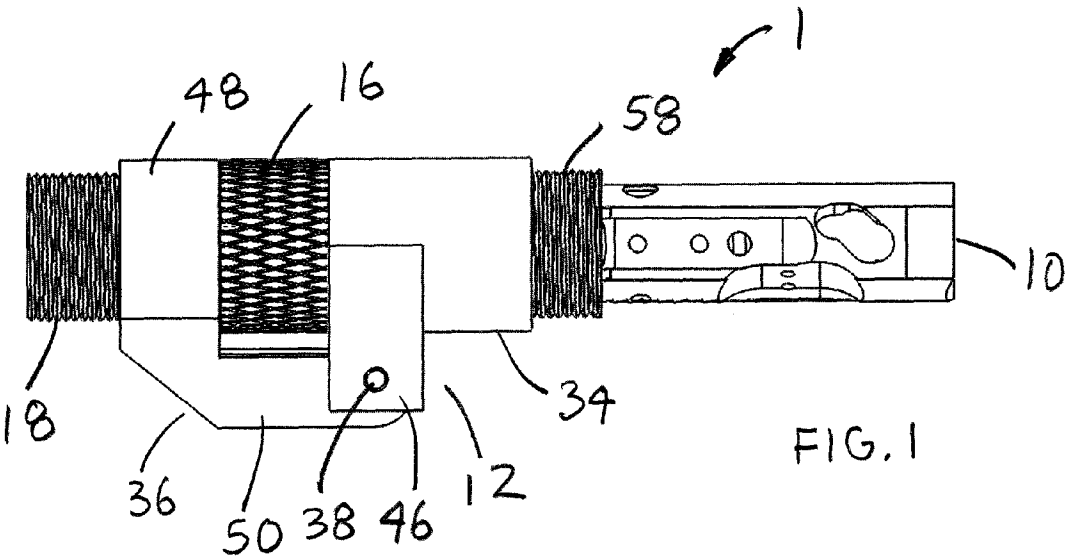
FIG. 1 is a top view of a folding stock attachment in accordance with the present invention.
Figure 2:
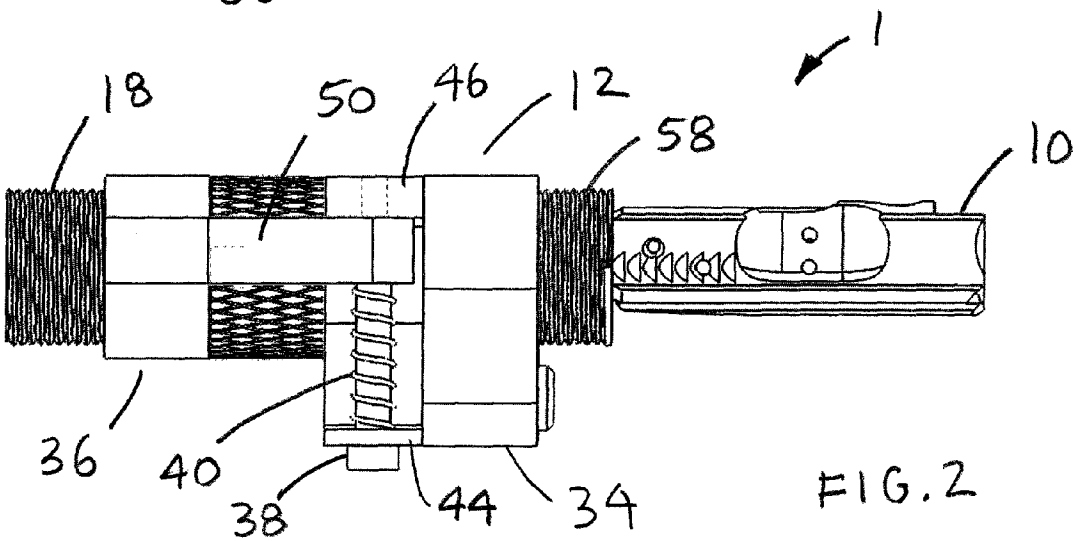
FIG. 2 is a right side view of a folding stock attachment in accordance with the present invention.
Figure 4:
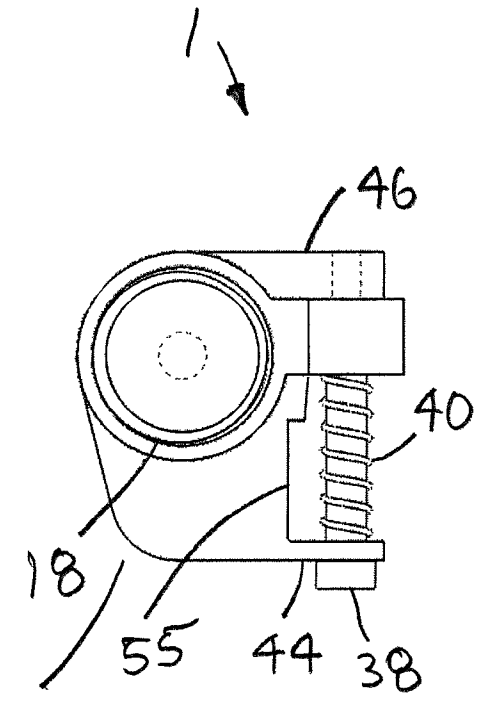
FIG. 4 is an end view of a folding stock attachment in accordance with the present invention.
Figure 3:
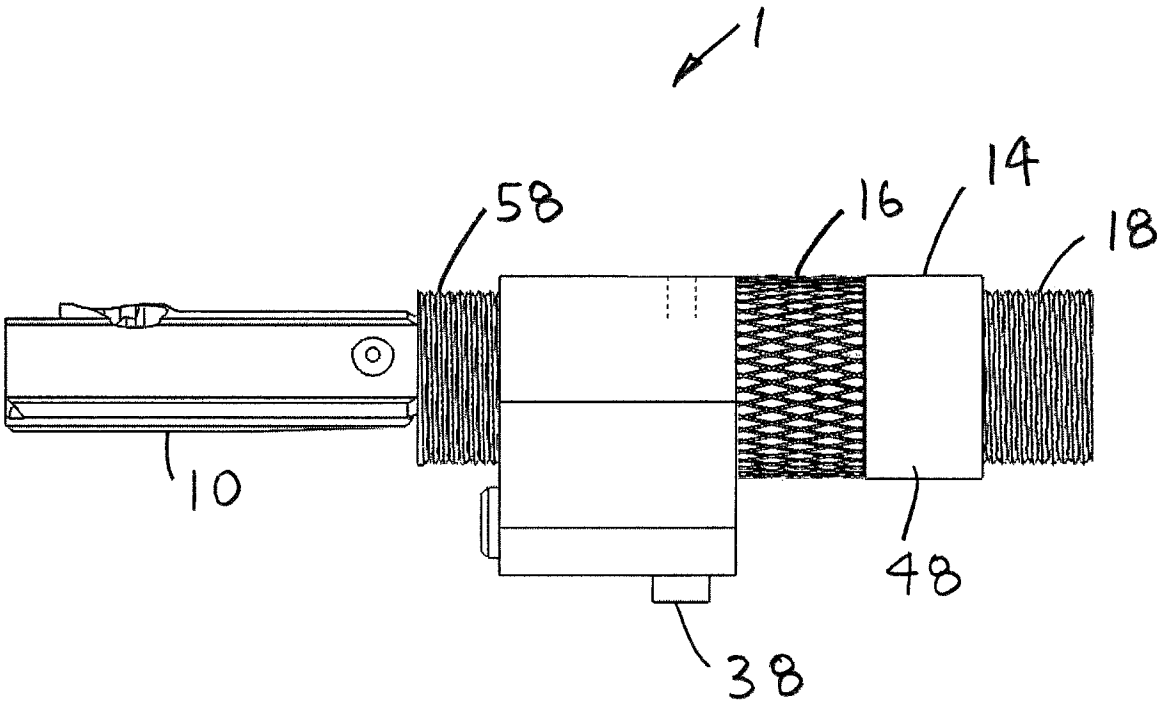
FIG. 3 is a left side view of a folding stock attachment in accordance with the present invention.
Figure 5:
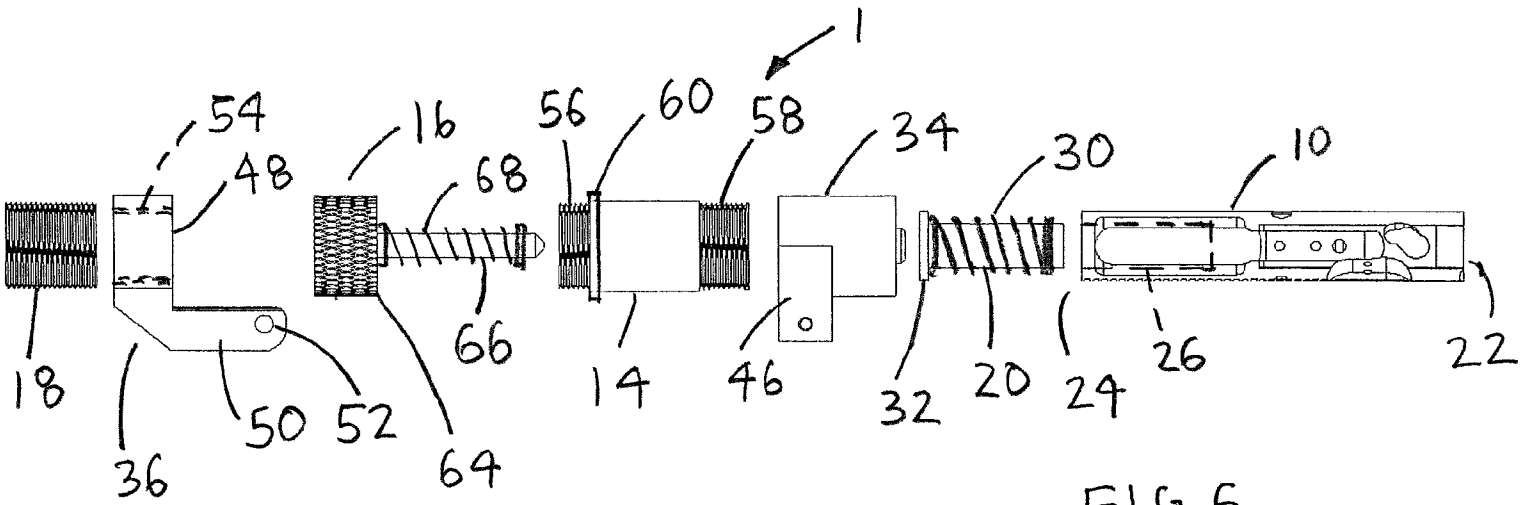
FIG. 5 is an exploded top view of a folding stock attachment in accordance with the present invention.
Figure 6:
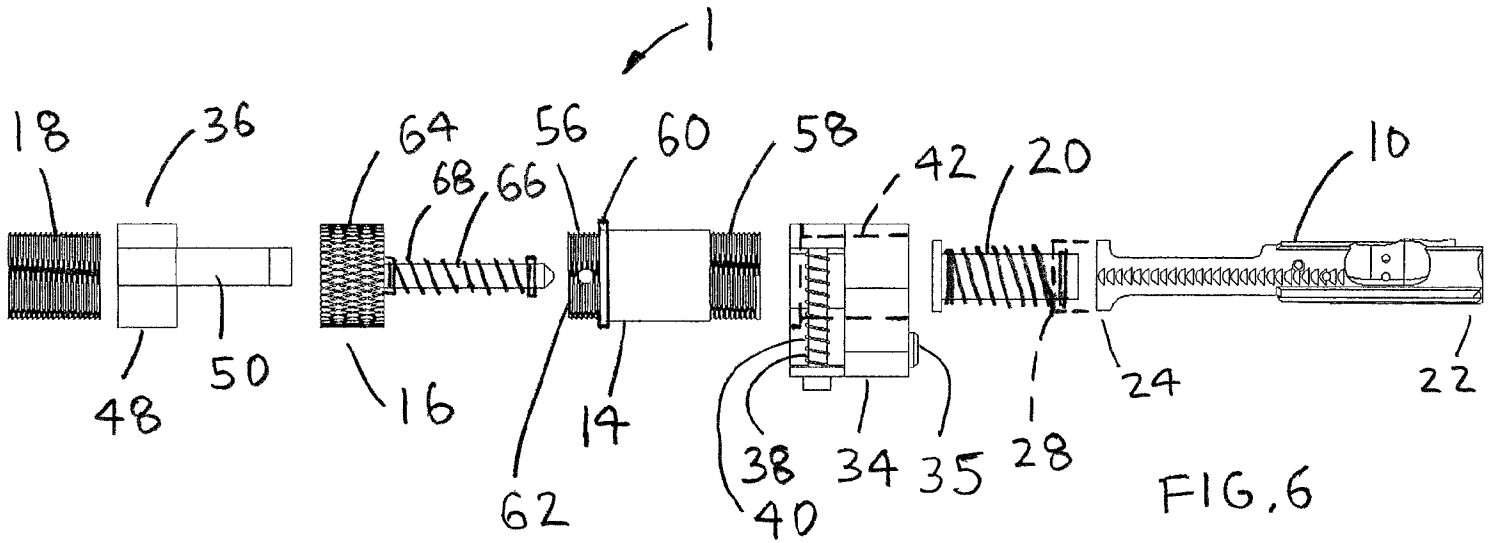
FIG. 6 is an exploded right side view of a folding stock attachment in accordance with the present invention.

With reference now to the drawings, and particularly to FIG. 1, there is shown a top view of a folding stock attachment 1. With reference to FIGS. 2-6, the folding stock attachment preferably includes a modified bolt carrier 10, a folding stock member 12, a shortened buffer tube 14, an end cap 16, a butt stock threaded tube 18 and a bolt carrier sleeve 20. The modified bolt carrier 10 includes a bolt end 22 and a buffer end 24. A sleeve bore 26 is formed in the buffer end 24 of the modified carrier bolt 10 to receive the bolt carrier sleeve 20. It is preferable to shorten the buffer end 24 by about 0.5-1 inch, before forming the sleeve bore 26. A sleeve spring 30 is placed on the bolt carrier sleeve 20. A sleeve flange 32 is formed on an end of the bolt carrier sleeve 20 to retain the sleeve spring 30. The folding stock member 12 includes a swing base 34, a swing arm 36, a pivot pin 38 and an arm spring 40. A tube bore 42 is formed through the swing base 34 to receive the shortened buffer tube 14. A lower base flange 44 extends outward from a bottom of the swing base 34 and an upper base flange 46 extends outward from a top of the swing base 34. Ends of the pivot pin 38 are retained in the lower and upper base flanges 44, 46. The arm spring 40 is retained on the pivot pin 38.

Figure 10:
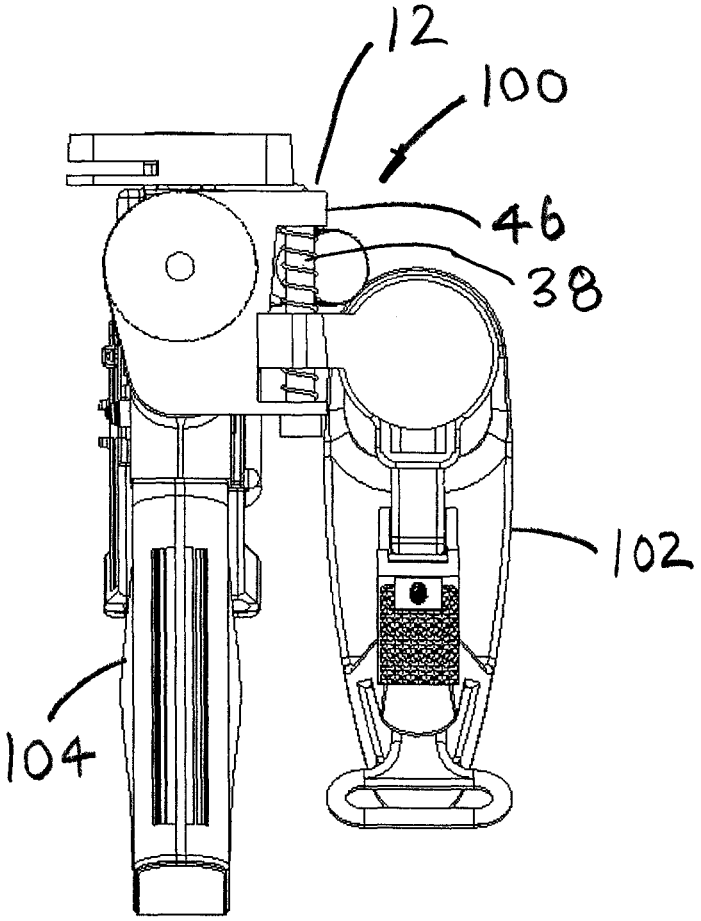
FIG. 10 is an end view of a folding stock attachment secured to a butt stock and a lower receiver of a firearm with the butt stock folded relative to the lower receiver in accordance with the present invention.

The swing arm 36 includes a butt stock ring 48 and a pivot arm 50. The pivot arm 50 extends from an outer perimeter of the stock ring 48. A pivot hole 52 is formed through a distal end of the pivot arm 50. The pivot hole 52 is sized to receive the pivot pin 38. With reference to FIG. 10, a notch 55 is formed in a sidewall of the swing base 34, adjacent the pivot pin 38 to hold the swing arm 36, such that a butt stock 102 of a firearm 100 is retained in a folded position. A threaded bore 54 is formed in the stock ring 48 to threadably receive the butt stock threaded tube 18. The shortened buffer tube 14 includes a first externally threaded end 56 and a second externally threaded end 58. A tube flange 60 is formed on an end of the first threaded end 56. A tightening through hole 62 is formed through the first externally threaded end 56 to receive a tightening rod (not shown) to allow the second externally threaded end 58 to tightened into a lower receiver 104.

Figure 7:
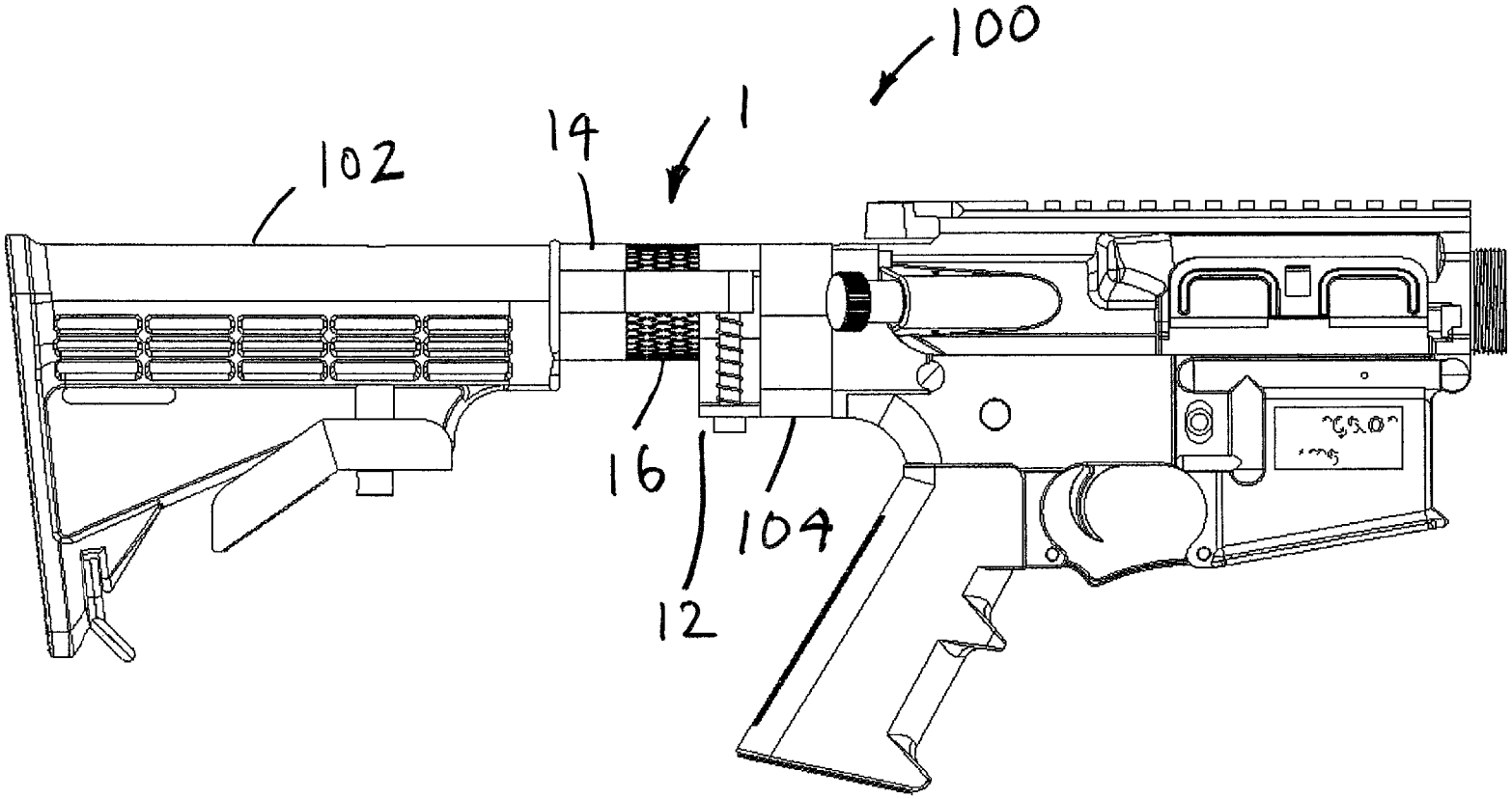
FIG. 7 is a right side view of a folding stock attachment secured to a butt stock and a lower receiver of a firearm in accordance with the present invention.
Figure 8:
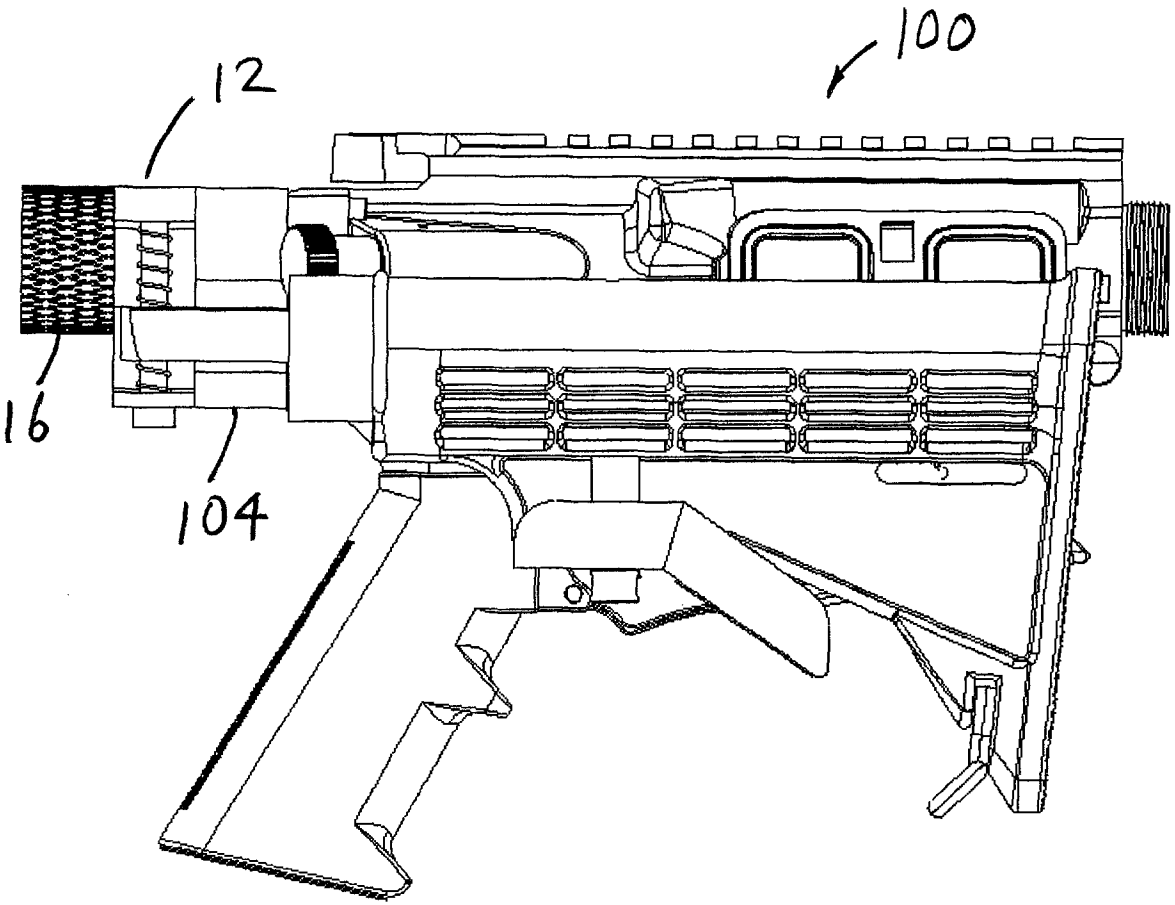
FIG. 8 is a right side view of a folding stock attachment secured to a butt stock and a lower receiver of a firearm with the butt stock folded relative to the lower receiver in accordance with the present invention.
Figure 9:
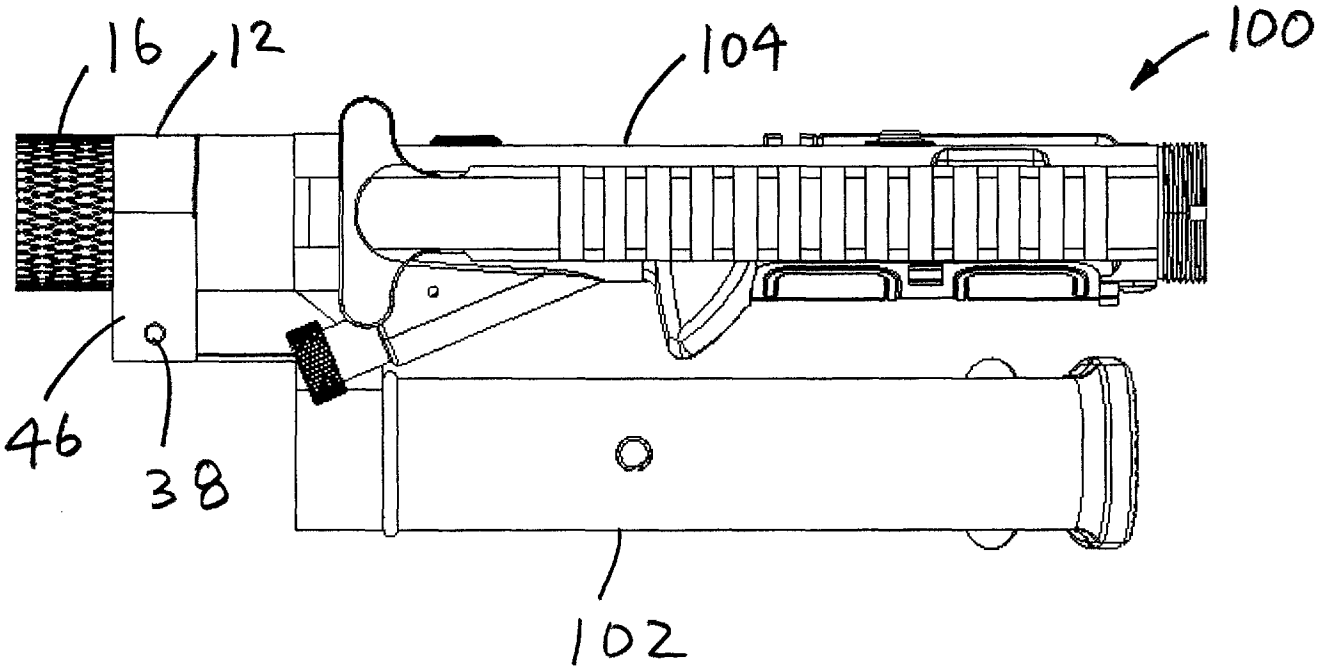
FIG. 9 is a top view of a folding stock attachment secured to a butt stock and a lower receiver of a firearm with the butt stock folded relative to the lower receiver in accordance with the present invention.

With reference to FIG. 7, the tightening rod is rotated to tighten the second externally threaded end 58 into a lower receiver 104 of the firearm 100. A sleeve flange bore is formed through the shortened buffer tube 14. The sleeve flange bore is sized to provide clearance for the tube flange 60. The end cap 16 includes an end cap portion 64 and a guide rod 66. A threaded counterbore is formed in one end of the end cap portion 64. The threaded counterbore is sized to threadably receive the first externally threaded end 56 of the shortened buffer tube 14. The guide rod 66 is pressed into the end cap portion 64. A guide spring 68 is placed on the guide rod 66. An inner perimeter of the bolt carrier sleeve 20 is sized to receive the guide rod 66.

The folding stock attachment 1 is preferably assembled in the following manner. The shortened buffer tube 14 is inserted into the tube bore 42 in the swing base 34. The second external threaded end 58 is threaded into the lower receiver 104 of the firearm 100. A non-rotation projection 35 preferably extends from the swing base 34 to engage an alignment hole in the lower receiver 104. The bolt carrier sleeve 20 is inserted into shortened buffer tube 14 and finally into the modified bolt carrier 10 with the sleeve spring 30 placed over the bolt carrier sleeve 20. The end cap 16 is threaded on to the first external thread 56 of the shortened buffer tube 14. One end of the butt stock threaded tube 18 is threaded into the swing arm 36. The other end of the butt stock threaded tube 18 is then threaded into the butt stock 102 of the firearm 100. The swing arm 36 is inserted into the swing base 38 and the pivot pin 38 is inserted through the top and bottom flanges 44, 46 with the spring 40 disposed below the pivot arm 50.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A folding stock attachment with modified bolt carrier for automatic recoil rifles and pistols comprising:

a bolt carrier sleeve;

a modified bolt carrier having a sleeve bore formed in one end thereof, said sleeve bore is sized to receive said bolt carrier sleeve;

a buffer tube having a first threaded end and a second threaded end;

a folding stock member includes a swing base and a swing arm, said swing arm is pivotally engaged with said swing base, a tube bore is formed through said swing base to receive said buffer tube;

an end cap includes an end cap portion and a guide rod, said guide rod extends from said end cap portion, said bolt carrier sleeve is sized to receive said guide rod, said first threaded end is threaded into said end cap; and a butt stock threaded tube having one end threaded into said swing arm, wherein the other end of said butt stock threaded tube is threaded into a butt stock of a firearm, said second threaded end is threaded into a lower receiver of the firearm.

2. The folding stock attachment with modified bolt carrier for automatic recoil rifles and pistols of claim 1, further comprising:

upper and lower flanges extend from a top and bottom of said swing base, a pivot pin is retained in said upper and lower flanges, said pivot pin pivotally retains said swing arm relative to said swing base.

3. The folding stock attachment with modified bolt carrier for automatic recoil rifles and pistols of claim 2, further comprising:

an arm spring is retained on said pivot pin, said arm spring is located below said upper flange on said pivot pin.

4. The folding stock attachment with modified bolt carrier for automatic recoil rifles and pistols of claim 1, further comprising:

a guide spring is placed on said guide rod.

5. The folding stock attachment with modified bolt carrier for automatic recoil rifles and pistols of claim 1, further comprising:

a sleeve spring is placed on said bolt carrier sleeve.

6. The folding stock attachment with modified bolt carrier for automatic recoil rifles and pistols of claim 1 wherein:

a notch is formed in a side of said swing base to vertically restrain said swing arm.

7. The folding stock attachment with modified bolt carrier for automatic recoil rifles and pistols of claim 1 wherein:

a length of said modified bolt carrier is shortened by at least 0.5 inches relative to an unmodified bolt carrier that is compatible with said automatic rifles and pistols.

8. The folding stock attachment with modified bolt carrier for automatic recoil rifles and pistols of claim 5 wherein:

a sleeve flange is formed on an end of said bolt carrier sleeve to retain said sleeve spring.

9. The folding stock attachment with modified bolt carrier for automatic recoil rifles and pistols of claim 1 wherein:

a tube flange is formed on an end of said first threaded end.

* * * * *